United States Patent [19]

Willman et al.

[11] Patent Number: 4,994,109

[45] Date of Patent: Feb. 19, 1991

[54] METHOD FOR PRODUCING PERMANENT MAGNET ALLOY PARTICLES FOR USE IN PRODUCING BONDED PERMANENT MAGNETS

[75] Inventors: Carol J. Willman, Bethel Park; Edward J. Dulis, Pittsburgh; Francis S. Snyder, Coraopolis, all of Pa.

[73] Assignee: Crucible Materials Corporation, Pittsburgh, Pa.

[21] Appl. No.: 347,660

[22] Filed: May 5, 1989

[51] Int. Cl.[5] ..... H01F 1/053; H01F 1/06

[52] U.S. Cl. ..... 75/338; 75/349; 148/101; 148/105

[58] Field of Search ..... 75/0.5 C, 338, 349; 148/101, 102, 105

[56] References Cited

FOREIGN PATENT DOCUMENTS 229804 10/1987 Japan .
109101 5/1988 Japan ..... 148/105
216307 9/1988 Japan ..... 148/105
216308 9/1988 Japan .

*Primary Examiner*—Theodore Morris
*Assistant Examiner*—George Wyszomierski
*Attorney, Agent, or Firm*—Finnegan, Henderson, Farabow, Garrett & Dunner

[57] ABSTRACT

A method for producing permanent magnet alloy particles suitable for use in producing bonded permanent magnets. A melt or molten mass of a permanent magnet alloy having at least one rare earth element, at least one transition element, preferably iron, and boron is produced. The melt is inert gas atomized to form spherical particles within the size range of 1 to 1000 microns. The particles are heat treated in a nonoxidizing atmosphere for a time at temperature to significantly increase the intrinsic coercivity of the particles without sintering the particles to substantially full density. Thereafter, the particles are separated to produce a discrete particle mass. The particles during heat treatment may be maintained in motion to prevent sintering thereof.

9 Claims, No Drawings

METHOD FOR PRODUCING PERMANENT MAGNET ALLOY PARTICLES FOR USE IN PRODUCING BONDED PERMANENT MAGNETS

BACKGROUND OF THE INVENTION

1. Field of the Invention

This invention relates to a method for producing permanent magnet alloy particles of a rare earth element containing permanent magnet alloy, which particles are suitable for use in producing bonded permanent magnets.

2. Description of the Prior Art

In various electrical applications, such as in electric motors, it is known to use bonded permanent magnets. Bonded permanent magnets are constructed of a dispersion of permanent magnet alloy particles in a bonding non-magnetic matrix of for example plastic. The permanent magnet particles are dispersed in the bonding matrix and the matrix is permitted to cure and harden either with or without magnetically orienting the dispersed particles therein.

Magnet alloys of at least one rare earth element, iron and boron are known to exhibit excellent energy product per unit volume and thus it is desirable to use these alloys in bonded magnets where low cost, high plasticity and good magnetic properties are required. It is likewise known with respect to these permanent magnet alloys that comminuting of these alloys to produce the fine particles required in the production of bonded magnets results in a significant decrease in the intrinsic coercivity of the alloy to a level wherein the particles are not suitable for use in producing bonded magnets. Hence, it is not possible to produce particles of these alloys for use in the production of bonded permanent magnets by comminuting castings of the alloy.

It is known to produce permanent magnet alloys of these compositions in particle form by inert gas atomization of a prealloyed melt of the alloy. The as-atomized particles, however, do not have sufficient intrinsic coercivity for use in producing bonded permanent magnets.

SUMMARY OF THE INVENTION

It is accordingly a primary object of the present invention to provide a method for producing permanent magnet alloy particles suitable for use in producing bonded permanent magnets wherein the required fine particle size in combination with the required coercivity is achieved.

Another object of the invention is to provide a method for producing permanent magnet alloy particles suitable for use in producing bonded permanent magents wherein the combination of particle size and coercivity is achieved without requiring comminution of a dense article, such as a casting, of the alloy to achieve the particles.

In accordance with the invention, and specifically the method thereof, permanent magnet alloy particles suitable for use in producing bonded permanent magnets are provided by producing a melt of a permanent magnet alloy comprising at least one rare earth element, at least one transition element and boron. The melt is inert gas atomized to form spherical particles within a particle size range of 1 to 1,000 microns. Thereafter, the particles are heat treated in a non-oxidizing atmosphere for a time at a temperature to significantly increase the intrinsic coercivity of the particles without sintering the particles to substantially full density. Thereafter, the particles are separated to produce a discrete particle mass.

Alternately, in acccordance with a second embodiment of the invention, heat treating may be conducted in a moving inert gas atmosphere while maintaining the particles in motion to significantly increase the intrinsic coercivity of the particles without substantially sintering the particles.

During heat treating, the intrinsic coercivity of the particles may be increased to at least 10,000 Oe. The heat treating temperature in accordance with the first embodiment of the invention may be less than 750° C. and less than 700° C. with respect to the second embodiment.

In the second embodiment of the invention the particles may be maintained in motion during heat treating by tumbling the particles in a rotating furnace. Alternately, a fluidized bed, a vibrating table or other conventional devices suitable for this purpose may be substituted for the rotating furnace.

After heat treating the particles may have a hard magnetic phase of $Nd_2Fe_{14}B$.

The rare earth element of the permanent magnet alloy may include neodymium or neodymium in combination with dysprosium.

The permanent magnet alloy may comprise, in weight percent, 29.5 to 40 total of at least one of the rare earth elements neodymium, praseodymium and dysprosium up to 4.5, 50 to 70 iron and the balance boron. Preferably, if dysprosium is present in combination with neodymium and/or praseodymium, the total content of all these elements is 29.5 to 40% with dysprosium being within the range of 0.7 to 4.5%. Alternatively, the permanent magnet alloy may comprise, in weight percent, 29.5 to 40% of at least one rare earth element neodymium, praseodymium, dysprosium, holmium, erbium, thulium, galium, indium or mischmetal, with at least 29.5% of this total rare earth element content being neodymium, up to 70% of at least one transition metal which may be iron, nickel and cobalt, with at least 50% iron, and 0.5 to 1.5% boron.

DETAILED DESCRIPTION OF THE PREFERRED EMBODIMENTS

Reference will now be made in detail to presently preferred embodiments of the invention, which are described in the following examples. In the examples and throughout the specification and claims, all parts and percentages are by weight percent unless otherwise specified.

EXAMPLE 1

Difficulty in the Generation of Coercivity in Comminuted Cast Alloys (As-cast Alloys Comminuted to Various Particle Sizes)

Three alloys of the compositions in weight percent designated in Table I were melted, cast and then processed to powder particles of varying size. The particles were mixed with molten paraffin wax and then aligned in a 25 kOe field. The composite was kept in a weak magnetic field until the wax hardened. The composite was pulse magnetized in a 35 kOe field. The intrinsic coercivities of the powder-wax composites were measured using a hysteresigraph. The results are listed in Table II.

TABLE I

| Compositions of Cast Alloys (weight percent) | | | | |
|---|---|---|---|---|
| Alloy Code | Nd | Dy | Fe | B |
| 1 | 35.2 | 1.6 | bal. | 1.26 |
| 2 | 37.4 | 1.4 | bal. | 1.22 |
| 3 | 39.3 | 1.7 | bal. | 1.21 |

TABLE II

| Intrinsic Coercivity As a Function of Particle Size - Crushed Cast Alloys | | |
|---|---|---|
| Alloy Code | Particle Size (mesh) | $H_{ci}$(Oe) |
| 1 | −35 + 200 | 300 |
| | −60 + 200 | 450 |
| | 5.4 microns* | 1100 |
| 2 | −35 + 200 | 350 |
| | −60 + 200 | 450 |
| | 2.41 microns* | 2300 |
| 3 | −30 + 200 | 300 |
| | −60 + 200 | 600 |
| | 5.6 microns* | 900 |

*Particle size listed in microns rather than by mesh size.

The composites had poor intrinsic coercivities rendering them unsuitable for use in a permanent magnet. Various heat treatments were conducted in an attempt to generate reasonable intrinsic coercivity in these ingot cast and crushed alloy composites. These attempts were unsuccessful. For example, after heat-treating samples of the crushed cast alloys of Table I for 3 hours at 500° C. the intrinsic coercivity $H_{ci}$ (Oe) values decreased. Samples of each alloy that showed the highest $H_{ci}$ values in the crushed and jet milled condition were loaded into a Vycor tube in an argon atmosphere and the tube was then evacuated. The powder in the Vycor tube was heat-treated at 500° C. for 3 hours. Test results on these powders were as follows:

TABLE II-A

| Intrinsic Coercivity of Crushed Cast Alloys after Heat-Treatment* | | |
|---|---|---|
| Alloy Code | Particle Size (mesh) | $H_{ci}$(Oe) |
| 1 | 5.4 microns | 500 |
| 2 | 2.41 microns | 1300 |
| 3 | 5.6 microns* | 1100 |

*Heat-Treatment - 500° C. for 3 hours.

EXAMPLE 2

Lack of Adequate Coercivity in As-Atomized Powder

An alloy of the composition in weight percent 31.3 Nd, 2.6 Dy, 64.4 Fe, and 1.13 B was vacuum induction melted and inert gas atomized. The alloy particles were screened to various particle sizes. Wax samples were prepared as described in Example 1. The as-atomized powder did not exhibit any significant level of coercivity, Table III.

TABLE III

| Intrinsic Coercivity as a Function of Particle Size: As-Atomized Powder | |
|---|---|
| Particle Size (mesh) | $H_{ci}$(Oe) |
| −60 + 100 | 2600 |
| −100 + 200 | 2600 |
| −200 + 325 | 3100 |
| −325 | 3800 |

EXAMPLE 3

Generation of Coercivity in Atomized Powders and Effect of Comminution on Heat Treated Atomized Powders Inert gas atomized powder in the as-atomized condition of the composition in weight percent 31.3 Nd, 2.6 Dy, 64.4 Fe and 1.13 B was screened to a particle size of −325 mesh ( 44 microns). The powder was heat treated in vacuum at various temperatures for 3 hours. Heat treatment at relatively low temperatures (500°-625° C.) resulted in varying degrees of densification (sintering), Table IV. A sample from this partially sintered material was ground square then pulse magnetized in a 35 KOe field. The intrinsic coercivity of the partially sintered material was measured using a hysteresigraph. The remaining portion of the partially sintered material was crushed to a −325 mesh (44 microns) powder. Wax samples were prepared using the procedure described in Example 1. The intrinsic coercivity of each sample was measured. The results are listed in Table V.

It may be observed from the data listed in Table V that the heat treatment resulted in high levels of coercivity in the atomized powder. This heat treatment resulted in various degrees of partial sintering as listed in Table IV. When the high coercivity partially sintered mass was crushed to yield powder, the intrinsic coercivity was degraded somewhat but the degree of coercivity loss was considerably less than that for the powder obtained by crushing solid, fully densified, magnets. This experiment indicates that atomized powder can be heat treated to yield a loosely (partially) densified powder which can be readily comminuted to yield a powder with a reasonably high $H_{ci}$.

TABLE IV

| Density Values for Partially Sintered* Heat Treated Atomized Powders (Time of Heat Treatment - 10 Hours) | | |
|---|---|---|
| Alloy | Temperature (°C.) | Density (g/cm³) |
| A | 500 | 4.56 |
| | 525 | 4.14 |
| | 550 | 4.33 |
| | 575 | 4.14 |
| | 600 | 4.19 |
| | 625 | 4.19 |
| B | 475 | 4.39 |
| | 500 | 4.45 |
| | 525 | 4.37 |
| | 550 | 4.40 |
| | 600 | 3.41 |
| | 625 | 4.40 |
| C | 475 | 4.26 |
| | 500 | 4.30 |
| | 525 | 4.45 |
| | 550 | 4.33 |
| | 575 | 4.07 |
| | 600 | 4.60 |
| | 625 | 4.37 |

| Composition (wt. %) | | | | |
|---|---|---|---|---|
| Alloy Code | Nd | Dy | Fe | B |
| A | 29.5 | 4.5 | bal. | 1.00 |
| B | 31.3 | 2.6 | bal. | 1.13 |
| C | 33.5 | 0.7 | bal. | 1.00 |

*Density of Fully Dense Solid Nd-Dy-Fe-B Magnets is 7.55 g/cm³.

TABLE V

Intrinsic Coercivity (KOe) as a Function of Heat Treatment Temprature: Various RE-Fe-B Alloys

| Alloy | Condition | (Time at Temperature - 10 Hours) Temperature (°C.) 475 | 500 | 525 | 550 | 575 | 600 | 625 |
|---|---|---|---|---|---|---|---|---|
| A | Part. sintered | N.M. | 3.6* | 14.6 | N.M. | 15.7 | 15.8 | 15.4 |
| | Powder | 11.7 | 12.7 | 12.2 | 12.7 | 12.8 | 13.8 | 13.8 |
| B | Part. sintered | 3.6* | 8.3* | 9.6 | 10.8 | 12.5 | 13.2 | 13.2 |
| | Powder | 9.6 | 10.3 | 8.8 | 9.7 | 9.9 | 10.6 | 9.3 |
| C | Part. sintered | 5.1* | 7.0* | 7.7 | 8.2 | 8.0 | 9.3 | 9.0 |
| | Powder | 6.5 | 5.2 | 6.9 | 7.5 | 7.2 | 7.9 | 7.9 |

| Alloy Code | Composition (wt. %) Nd | Dy | Fe | B |
|---|---|---|---|---|
| A | 29.5 | 4.5 | bal. | 1.00 |
| B | 31.3 | 2.6 | bal. | 1.13 |
| C | 33.5 | 0.7 | bal. | 1.00 |

N.M. = Not measured
* = Sample was very soft and thus difficult to measure accurately.

EXAMPLE 4

Effect of Heat Treatment on Intrinsic Coercivity and Densification of Atomized Powders While in a Dynamic Heat Treatment Atmosphere Inert gas atomized alloy spherical powder of the composition in weight percent 31.3 Nd, 2.6 Dy, 64.4 Fe and 1.13 B was heat treated in a flowing inert gas atmosphere rotating furnace apparatus to enable the generation of coercivity (generation of appropriate metallurgical structure by heat treatment required for desired $H_{ci}$) while minimizing the degree of sintering. When heat treated using similar time and temperature parameters as described in Example 3, the use of the rotating furnace apparatus minimized the amount of sintering and enabled a powder having adequate intrinsic coercivity for bonded magnets to be obtained, Table VI.

The intrinsic coercivity test results show that a significant improvement in intrinsic coercivity occurs when the as-atomized powder ($H_{ci}$=5800 Oe) is heat-treated at different temperatures up to 750° C. For the −325 mesh powder that did not partially sinter during the heat treatment in an inert gas atmosphere, the optimum temperature of heat treatment was below 700° C. Above this temperature, a drop in coercivity occurs. For the partially sintered spherical gas atomized powder that had been heated in the same temperature range in an inert gas atmosphere, prior to comminuting to −325 mesh, the optimum temperatures of heat treatment were below 750° C.

TABLE VI

Intrinsic Coercivity of Heat-Treated, Gas Atomized -325 Mesh Powder After Various Treatments Wt. % (Alloy B - 31.3 Nd, 2.6 Dy, 1.1 B, Bal. Fe)

| Heat Treatment, °C. | Heat Treated Powder $H_{ci}$, Oe | Heat-Treated Partially Sintered Powder Crushed to −325 Mesh Powder $H_{ci}$Oe |
|---|---|---|
| As-Atomized, $H_{ci}$ = 5800 Oe | — | — |
| 500, 10 hrs. | 10,700 | — |
| 550, 10 hrs. | 12,000 | 11,500 |
| 600, 10 hrs. | 11,200 | 11,500 |
| 600, 22 hrs. | 10,600 | 12,000 |
| 650, 10 hrs. | 10,400 | 11,500 |
| 700, 10 hrs. | 6,300 | 12,000 |
| 750, 10 hrs. | 6,200 | 9,900 |

EXAMPLE 5

Gas atomized Alloy A (29.5% Nd, 4.5% Dy, 1.0% B, Bal. Fe) powder was heat treated in a flowing inert gas atmosphere rotating furnace at various times and temperatures and screened to different size fractions, Table VII. The furnace was constructed to provide an inert atmosphere and continuous movement and thus yield without sintering a heat treated powder with adequate $H_{ci}$.

The intrinsic coercivity test results on samples of different size material show that very good coercivities are obtained regardless of the size of the spherical atomized powder. Higher values were obtained, however, on the size fractions above −325 mesh.

TABLE VII

Intrinsic Coercivity of Heat-Treated Gas-Atomized Powder of Various Size Fractions Wt. % (Alloy A - 29.5 Nd, 4.5 Dy, 1.0 B, Bal. Fe)

| Powder Size Mesh | 500 C.-22 Hrs. Oe | 600 C.-10 Hrs. Oe | 600 C.-22 Hrs. Oe | 650C-22 Hrs. Oe |
|---|---|---|---|---|
| −325 | 10,800 | 11,100 | 11,100 | 10,300 |
| +325 | 14,600 | 15,500 | 15,700 | 15,000 |
| −30 to 60 | 15,400 | 13,800 | ND | 14,600 |
| −60 to 100 | 15,700 | 14,600 | ND | 15,300 |
| −100 to 200 | 15,000 | 15,100 | ND | 13,900 |
| −200 to 325 | 12,600 | 13,700 | ND | 11,600 |

ND - Not Determined

What is claimed is:

1. A method for producing permanent magnet alloy particles suitable for use in producing bonded permanent magnets, said method comprising, producing a melt of a permanent magnet alloy comprising at least one rare earth element, at least one transition element and boron, inert gas atomizing said melt to form spherical particles of a particle size larger than 325 mesh and heat treating said particles at a temperature of 475 to 700 degrees C in a nonoxidizing atmosphere for a time at said temperature to increase the intrinsic coercivity of said particles to at least 10,000 Oe without sintering said particles to substantially full density and thereafter separating said particles to produce a discrete particle mass.

2. A method for producing permanent magnet alloy particles suitable for use in producing bonded permanent magnets, said method comprising producing a melt of a permanent magnet alloy comprising at least one rare earth element at least one transition element and boron, inert gas atomizing said melt to form spherical particles of a particle size larger than −325 mesh, and heat treating said particles at a temperature of 475 to 700 degrees C for a time at said temperature and in a moving inert gas atmosphere to maintain said particles in motion and to increase the intrinsic coercivity of said particles to at least 10,000 Oe without substantially sintering said particles.

3. The method of claim 2 wherein said particles are maintained in motion during said heat treating by tumbling said particles in a rotating furnace.

4. The method of claim 1 or claim 2 wherein said particles after said heat treating have a $Nd_2Fe_{14}B$ hard magnetic phase.

5. The method of claim 1 or claim 2 wherein said at least one rare earth element includes neodymium.

6. The method of claim 1 or claim 2 wherein said at least one rare earth element includes neodymium and dysprosium.

7. The method of claim 1 or claim 2 wherein said permanent magnet alloy comprises, in weight percent, 29.5 to 40 total of at least one rare earth element selected from the group consisting of neodymium, praesodymium and dysprosium, dysprosium when present being not greater than 4.5, 50 to 70 iron and balance boron.

8. The method of claim 1 or claim 2 wherein said permanent magnet alloy comprises, in weight percent, 29.5 to 40 total of at least one rare earth element selected from the group consisting of neodymium, praesodymium, dysprosium, holmium, erbium, thulium, galium, indium and mischmetal, with at least 29.5 neodymium, up to 70 of at least one transition metal selected from the group consisting of iron, nickel and cobalt, with at least 50 iron, and 0.5 to 1.5 boron.

9. The method of claim 1 or claim 2 wherein said permanent magnet alloy comprises, in weight percent, 29.5 to 40 total of at least one rare earth element selected from the group consisting of neodymium, praesodymium and dysprosium, with dysprosium when present being within the range of 0.7 to 4.5.

* * * * *

UNITED STATES PATENT AND TRADEMARK OFFICE

CERTIFICATE OF CORRECTION

PATENT NO. : 4,994,109

DATED : February 19, 1991

INVENTOR(S) : Carol J. WILLMAN et al.

It is certified that error appears in the above-identified patent and that said Letters Patent is hereby corrected as shown below:

Claim 2, column 7, line 21, change "-325" to -- 325 --.

Signed and Sealed this

Fourteenth Day of July, 1992

*Attest:*

DOUGLAS B. COMER

*Attesting Officer*

*Acting Commissioner of Patents and Trademarks*